US007318035B2

(12) United States Patent
Andersen et al.

(10) Patent No.: US 7,318,035 B2
(45) Date of Patent: Jan. 8, 2008

(54) AUDIO CODING SYSTEMS AND METHODS USING SPECTRAL COMPONENT COUPLING AND SPECTRAL COMPONENT REGENERATION

(75) Inventors: Robert Loring Andersen, San Francisco, CA (US); Michael Mead Truman, San Francisco, CA (US); Philip Anthony Williams, San Francisco, CA (US); Stephen Decker Vernon, Hillsborough, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 847 days.

(21) Appl. No.: 10/434,449

(22) Filed: May 8, 2003

(65) Prior Publication Data

US 2004/0225505 A1 Nov. 11, 2004

(51) Int. Cl.
*G10L 19/00* (2006.01)

(52) U.S. Cl. ..... 704/500; 704/206; 704/501; 704/503

(58) Field of Classification Search ..... 704/206, 704/500, 200.1, 260, 503
See application file for complete search history.

(56) References Cited

U.S. PATENT DOCUMENTS

| | | | |
|---|---|---|---|
| 3,684,838 | A | 8/1972 | Kahn |
| 3,995,115 | A | 11/1976 | Kelly |
| 4,610,022 | A | 9/1986 | Kitayama |
| 4,667,340 | A | 5/1987 | Arjmand et al. |
| 4,757,517 | A | 7/1988 | Yatsuzuka |
| 4,776,014 | A | 10/1988 | Zinser, Jr. |
| 4,790,016 | A | 12/1988 | Mazor et al. |
| 4,885,790 | A | 12/1989 | McAulay et al. |
| 4,914,701 | A | 4/1990 | Zibman |
| 4,935,963 | A | 6/1990 | Jain |
| 5,001,758 | A | 3/1991 | Galand et al. |
| 5,054,072 | A | 10/1991 | McAulay et al. |
| 5,054,075 | A | 10/1991 | Hong et al. |

(Continued)

FOREIGN PATENT DOCUMENTS

| | | |
|---|---|---|
| DE | 19509149 | 9/1996 |

(Continued)

OTHER PUBLICATIONS

Grauel, Christoph, "Sub-Band Coding with Adaptive Bit Allocation," Signal Processing, vol. 2 No. 1 Jan. 1980, No. Holland Publishing Co., ISSN 0 165-1684, pp. 23-30.

(Continued)

*Primary Examiner*—Richemond Dorvil
*Assistant Examiner*—Qi Han
(74) *Attorney, Agent, or Firm*—David N. Lathrop, Esq.; Gallagher & Lathrop

(57) ABSTRACT

An audio encoder discards spectral components of an input signal and uses channel coupling to reduce the information capacity requirements of an encoded signal. Channel coupling represents selected spectral components of multiple channels of signals in a composite form. An audio decoder synthesizes spectral components to replace the discarded spectral components and generates spectral components for individual channel signals from the coupled-channel signal. The encoder provides scale factors in the encoded signal that improve the efficiency of the decoder to generate output signals that substantially preserve the spectral energy of the original input signals.

65 Claims, 5 Drawing Sheets

U.S. PATENT DOCUMENTS

| | | | | |
|---|---|---|---|---|
| 5,109,417 | A | 4/1992 | Fielder et al. | |
| 5,127,054 | A | 6/1992 | Hong et al. | |
| 5,394,473 | A | 2/1995 | Davidson | |
| 5,583,962 | A | 12/1996 | Davis et al. | |
| 5,636,324 | A | 6/1997 | Teh et al. | |
| 5,812,971 | A * | 9/1998 | Herre | 704/230 |
| 5,937,000 | A * | 8/1999 | Lee et al. | 375/141 |
| RE36,478 | E | 12/1999 | McAulay et al. | |
| 6,341,165 | B1 | 1/2002 | Brandenburg et al. | |
| 6,424,939 | B1 | 7/2002 | Herre | |
| 6,675,144 | B1 * | 1/2004 | Tucker et al. | 704/264 |
| 6,680,972 | B1 * | 1/2004 | Liljeryd et al. | 375/240 |
| 6,708,145 | B1 * | 3/2004 | Liljeryd et al. | 704/200.1 |
| 2005/0065785 | A1 * | 3/2005 | Bessette | 704/211 |

FOREIGN PATENT DOCUMENTS

| | | |
|---|---|---|
| EP | 0746116 | 4/1996 |
| WO | WO 9857436 | 12/1998 |
| WO | WO-0045379 | 8/2000 |
| WO | WO 0191111 | 11/2001 |
| WO | WO-02/41302 | 5/2002 |

OTHER PUBLICATIONS

ATSC Standard: Digital Audio Compression (AC-3), Revision A, Aug. 20, 2001, Sections 1-4, 6, 7.3 and 8.

Bosi, et al., "ISO/IEC MPEG-2 Advanced Audio Coding," J. Audio Eng. Soc., vol. 45, No. 10, Oct. 1997, pp. 789-814.

Makhoul, et al.; "High-Frequency Regeneration in Speech Coding Systems" IEEE Int. Conf. Sys. (ICASSP 79), Mar. 1979, pp. 428-431.

Galand, et al.; "High-Frequency Regeneration of Base-Band Vocoders by Multi-pulse Excitation" IEEE Int. Conf. Sys. (ICASSP 87), Apr. 1987, pp. 1934-1937.

Laroche, et al., "New phase-Vocoder Techniques for Pitch-Shifting, Harmonizing and Other Exotic Effects" Proc. IEEE Workshop on Applications of Signal Processing to Audio and Acoustics, New Paltz, new York, Oct. 17-20, 1999, p. 91-94.

Stott, Jonathan, "DRM-key technical features" EBU Technical Review, Mar. 2001, pp. 1-24.

Zinser, R. L., "An Efficient, Pitch-Aligned High-Frequency Regeneration Technique for RELP Vocoders" IEEE 1985, p. 969-972.

Atkinson, I. A.; et al., "Time Envelope LP Vocoder: A New Coding Technique at Very Low Bit Rates,"4th European Conf on Speech Comm. & Tech., ESCA EUROSPEECH Sep. '95 Madrid, ISSN 1018-4074, pp. 241-244.

Edler, "Codierung von Audiosignalen mit uberlappender Transformation und Adaptivene Fensterfunktionen," Frequenz, 1989, vol. 43, pp. 252-256.

Herre, et al., "Enhancing the Performance of Perceptual Audio Coders by Using Temporal Noise Shaping (TNS)," 101st AES Convention, Nov. 1996, preprint 4384.

Herre, et al., "Exploiting Both Time and Frequency Structure in a System That Uses an Analysis/Synthesis Filterbank with High Frequency Resolution," 103rd AES Convention, Sep. 1997, preprint 4519.

Herre, et al., "Extending the MPEG-4 AAC Codec by Perceptual Noise Substitution," 104th AES Convention, May 1998, preprint 4720.

Rabiner, et al., "Digital Processing of Speech Signals,": Prentice-Hall, 1978, pp. 396-404.

Sugiyama, et. al., "Adaptive Transform Coding With an Adaptive Block Size (ATC-ABS)", IEEE Intl. Con£ on Acoust., Speech, and Sig. Proc., Apr. 1990.

Liu, Chi-Min, et al.; "Design of the Coupling Schemes for the Dolby AC-3 Coder in Stereo Coding", Int. Conf. on Consumer Electronics, ICCE, Jun. 2, 1998, IEEE XP010283089; pp. 328-329.

Hans, M., et al., "An MPEG Audio Layered Transcoder" preprints of papers presented at the AES Convention, XX, XX, Sep. 1998, pp. 1-18.

Nakajima, Y., et al. "MPEG Audio Bit Rate Scaling On Coded Data Domain" Acoustics, Speech and Signal Processing, 1998, Proceedings of the 1998 IEEE Int'l. Conf. on Seattle, WA, May 12-15, 1998, New York IEEE pp. 3669-3672.

Ehret, A., et al., "Technical Description of Coding Technologies' Proposal for MPEG-4 v3 General Audio Bandwidth Extension: Spectral Band Replication (SBR)", Coding Technologies AB/GmbH.

* cited by examiner

AUDIO CODING SYSTEMS AND METHODS USING SPECTRAL COMPONENT COUPLING AND SPECTRAL COMPONENT REGENERATION

TECHNICAL FIELD

The present invention pertains to audio encoding and decoding devices and methods for transmission, recording and playback of audio signals. More particularly, the present invention provides for a reduction of information required to transmit or record a given audio signal while maintaining a given level of perceived quality in the playback output signal.

BACKGROUND ART

Many communications systems face the problem that the demand for information transmission and recording capacity often exceeds the available capacity. As a result, there is considerable interest among those in the fields of broadcasting and recording to reduce the amount of information required to transmit or record an audio signal intended for human perception without degrading its perceived quality. There is also an interest to improve the perceived quality of the output signal for a given bandwidth or storage capacity.

Traditional methods for reducing information capacity requirements involve transmitting or recording only selected portions of the input signal. The remaining portions are discarded. Techniques known as perceptual encoding typically convert an original audio signal into spectral components or frequency subband signals so that those portions of the signal that are either redundant or irrelevant can be more easily identified and discarded. A signal portion is deemed to be redundant if it can be recreated from other portions of the signal. A signal portion is deemed to be irrelevant if it is perceptually insignificant or inaudible. A perceptual decoder can recreate the missing redundant portions from an encoded signal but it cannot create any missing irrelevant information that was not also redundant. The loss of irrelevant information is acceptable, however, because its absence has no perceptible effect on the decoded signal.

A signal encoding technique is perceptually transparent if it discards only those portions of a signal that are either redundant or perceptually irrelevant. If a perceptually transparent technique cannot achieve a sufficient reduction in information capacity requirements, then a perceptually non-transparent technique is needed to discard additional signal portions that are not redundant and are perceptually relevant. The inevitable result is that the perceived fidelity of the transmitted or recorded signal is degraded. Preferably, a perceptually non-transparent technique discards only those portions of the signal deemed to have the least perceptual significance.

An encoding technique referred to as "coupling," which is often regarded as a perceptually non-transparent technique, may be used to reduce information capacity requirements. According to this technique, the spectral components in two or more input audio signals are combined to form a coupled-channel signal with a composite representation of these spectral components. Side information is also generated that represents a spectral envelope of the spectral components in each of the input audio signals that are combined to form the composite representation. An encoded signal that includes the coupled-channel signal and the side information is transmitted or recorded for subsequent decoding by a receiver. The receiver generates decoupled signals, which are inexact replicas of the original input signals, by generating copies of the coupled-channel signal and using the side information to scale spectral components in the copied signals so that the spectral envelopes of the original input signals are substantially restored. A typical coupling technique for a two-channel stereo system combines high-frequency components of the left and right channel signals to form a single signal of composite high-frequency components and generates side information representing the spectral envelopes of the high-frequency components in the original left and right channel signals. One example of a coupling technique is described in "Digital Audio Compression (AC-3)," Advanced Television Systems Committee (ATSC) Standard document A/52, which is incorporated by reference in its entirety.

The information capacity requirements of the side information and the coupled-channel signal should be chosen to optimize a tradeoff between two competing needs. If the information capacity requirement for the side information is set too high, the coupled-channel will be forced to convey its spectral components at a low level of accuracy. Lower levels of accuracy in the coupled-channel spectral components may cause audible levels of coding noise or quantizing noise to be injected into the decoupled signals. Conversely, if the information capacity requirement of the coupled-channel signal is set too high, the side information will be forced to convey the spectral envelopes with a low level of spectral detail. Lower levels of detail in the spectral envelopes may cause audible differences in the spectral level and shape of each decoupled signal.

Generally, a good tradeoff can be achieved if the side information conveys the spectral level of frequency subbands that have bandwidths commensurate with the critical bands of the human auditory system. It may be noted that the decoupled signals may be able to preserve spectral levels of the original spectral components of original input signals but they generally do not preserve the phase of the original spectral components. This loss of phase information can be imperceptible if coupling is limited to high-frequency spectral components because the human auditory system is relatively insensitive to changes in phase, especially at high frequencies.

The side information that is generated by traditional coupling techniques has typically been a measure of spectral amplitude. As a result, the decoder in a typical system calculates scale factors based on energy measures that are derived from spectral amplitudes. These calculations generally require computing the square root of the sum of the squares of values obtained from the side information, which requires substantial computational resources.

An encoding technique sometimes referred to as "high-frequency regeneration" (HFR) is a perceptually non-transparent technique that may be used to reduce information capacity requirements. According to this technique, a baseband signal containing only low-frequency components of an input audio signal is transmitted or stored. Side information is also provided that represents a spectral envelope of the original high-frequency components. An encoded signal that includes the baseband signal and the side information is transmitted or recorded for subsequent decoding by a receiver. The receiver regenerates the omitted high-frequency components with spectral levels based on the side information and combines the baseband signal with the regenerated high-frequency components to produce an output signal. A description of known methods for HFR can be found in Makhoul and Berouti, "High-Frequency Regeneration in Speech Coding Systems", *Proc. of the International*

*Conf. on Acoust., Speech and Signal Proc.*, April 1979. An improved HFR technique that is suitable for encoding high-quality music is disclosed in U.S. patent application Ser. No. 10/113,858 entitled "Broadband Frequency Translation for High Frequency Regeneration" filed Mar. 28, 2002, which is incorporated by reference in its entirety and is referred to below as the HFR application.

The information capacity requirements of the side information and the baseband signal should be chosen to optimize a tradeoff between two competing needs. If the information capacity requirement for the side information is set too high, the encoded signal will be forced to convey the spectral components in the baseband signal at a low level of accuracy. Lower levels of accuracy in the baseband signal spectral components may cause audible levels of coding noise or quantizing noise to be injected into the baseband signal and other signals that are synthesized from it. Conversely, if the information capacity requirement of the baseband signal is set too high, the side information will be forced to convey the spectral envelopes with a low level of spectral detail. Lower levels of detail in the spectral envelopes may cause audible differences in the spectral level and shape of each synthesized signal.

Generally, a good tradeoff can be achieved if the side information conveys the spectral levels of frequency subbands that have bandwidths commensurate with the critical bands of the human auditory system.

Just as for the coupling technique discussed above, the side information that is generated by traditional HFR techniques has typically been a measure of spectral amplitude. As a result, the decoder in typical systems calculates scale factors based on energy measures that are derived from spectral amplitudes. These calculations generally require computing the square root of the sum of the squares of values obtained from the side information, which requires substantial computational resources.

Traditional systems have used either coupling techniques or HFR techniques but not both. In many applications, the coupling techniques may cause less signal degradation than HFR techniques but HFR techniques can achieve greater reductions in information capacity requirements. The HFR techniques can be used advantageously in multi-channel and single-channel applications; however, coupling techniques do not offer any advantage in single-channel applications.

DISCLOSURE OF INVENTION

It is an object of the present invention to provide for improvements in signal processing techniques like those that implement coupling and HFR in audio coding systems.

According to one aspect of the present invention, a method for encoding one or more input audio signals includes steps that obtain one or more baseband signals and one or more residual signals from the input audio signals, where spectral components of the baseband signals are in a first set of frequency subbands and spectral components in the residual signals are in a second set of frequency subbands that are not represented by the baseband signals; obtain energy measures of spectral components of one or more synthesized signals to be generated within the second set of frequency subbands during decoding; obtain energy measures of spectral components of the residual signals; calculate scale factors by obtaining square roots and ratios of the energy measures of spectral components in the residual signals and in the synthesized signals; and assemble into an encoded signal scaling information that represents the scale factors and signal information that represents the spectral components in the baseband signals.

According to another aspect of the present invention, a method for decoding an encoded signal representing one or more input audio signals includes steps that obtain scaling information and signal information from the encoded signal, where the scaling information represents scale factors calculated by obtaining square roots and ratios of energy measures of spectral components and the signal information represents spectral components for one or more baseband signals, and where the spectral components in the baseband signals represent spectral components of the input audio signals in a first set of frequency subbands; generate for the baseband signals associated synthesized signals having spectral components in a second set of frequency subbands that are not represented by the baseband signals, where the spectral components in the synthesized signals are scaled by multiplication or division according to one or more of the scale factors; and generate one or more output audio signals that represent the input audio signals and are generated from spectral components in the baseband signals and the associated synthesized signals.

According to yet another aspect of the present invention, a method for encoding a plurality of input audio signals includes steps that obtain a plurality of baseband signals, a plurality of residual signals and a coupled-channel signal from the input audio signals, where spectral components of the baseband signals represent spectral components of the input audio signals in a first set of frequency subbands and spectral components of the residual signals represent spectral components of the input audio signals in a second set of frequency subbands that are not represented by the baseband signals, and where spectral components of the coupled-channel signal represent a composite of spectral components of two or more of the input audio signals in a third set of frequency subbands; obtain energy measures of spectral components of the residual signals and the two or more input audio signals represented by the coupled-channel signal; and assemble into an encoded signal scaling information that is derived from the energy measures and signal information that represents the spectral components in the baseband signals and the coupled-channel signal.

According to a further aspect of the present invention, a method for decoding an encoded signal representing a plurality of input audio signals includes steps that obtain control information and signal information from the encoded signal, where the control information is derived from energy measures of spectral components and the signal information represents spectral components of a plurality of baseband signals and a coupled-channel signal, the spectral components in the baseband signals representing spectral components of the input audio signals in a first set of frequency subbands and the spectral components of the coupled-channel signal representing a composite of spectral components in a third set of frequency subbands of two or more of the input audio signals; generate for the baseband signals associated synthesized signals having spectral components in a second set of frequency subbands that are not represented by the baseband signals, where the spectral components in the associated synthesized signal are scaled according to the control information; generate from the coupled-channel signal decoupled signals for the two or more input audio signals represented by the coupled-channel signal, where the decoupled signals have spectral components in the third set of frequency subbands that are scaled according to the control information; and generate a plurality of output audio signals representing the input audio signals from the spectral components in the baseband signals and associated synthesized signals, wherein output audio signals representing the two or more audio signals are also generated from the spectral components in respective decoupled signals.

Other aspects of the present invention include devices with processing circuitry that perform various encoding and decoding methods, media that convey programs of instructions executable by a device that cause the device to perform various encoding and decoding methods, and media that convey encoded information representing input audio signals that is generated by various encoding methods.

The various features of the present invention and its preferred embodiments may be better understood by referring to the following discussion and the accompanying drawings in which like reference numbers refer to like elements in the several figures. The contents of the following discussion and the drawings are set forth as examples only and should not be understood to represent limitations upon the scope of the present invention.

MODES FOR CARRYING OUT THE INVENTION

A. Overview

The present invention pertains to audio coding systems and methods that reduce information capacity requirements of an encoded signal by discarding a "residual" portion of an original input audio signal and encoding only a baseband portion of the original input audio signal, and subsequently decoding the encoded signal by generating a synthesized signal to substitute for the missing residual portion. The encoded signal includes scaling information that is used by the decoding process to control signal synthesis so that the synthesized signal preserves to some degree the spectral levels of the residual portion of the original input audio signal.

This coding technique is referred to herein as High Frequency Regeneration (HFR) because it is anticipated that in many implementations the residual signal will contain the higher-frequency spectral components. In principle, however, this technique is not restricted to the synthesis of only high-frequency spectral components. The baseband signal could include some or all of the higher-frequency spectral components, or could include spectral components in frequency subbands scattered throughout the total bandwidth of an input signal.

1. Encoder

Figure 1:
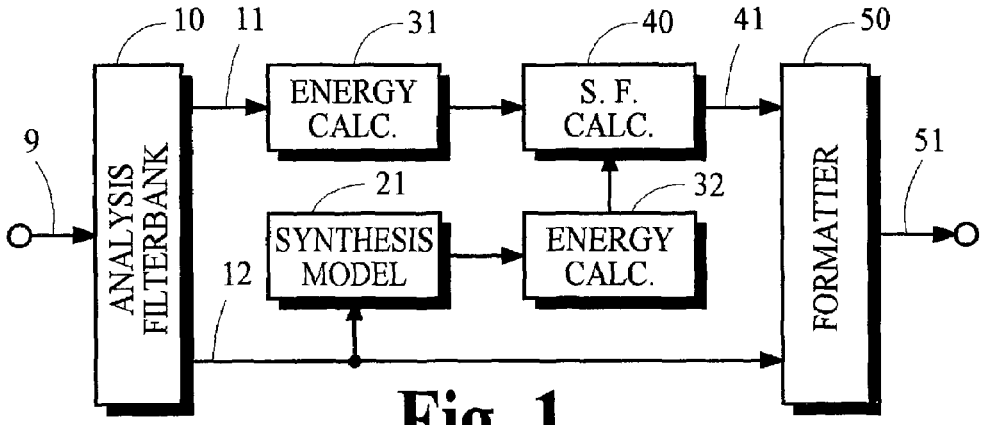
FIG. 1 is a schematic block diagram of a device that encodes an audio signal for subsequent decoding by a device using high-frequency regeneration.

FIG. 1 illustrates an audio encoder that receives an input audio signal and generates an encoded signal representing the input audio signal. The analysis filterbank 10 receives the input audio signal from the path 9 and, in response, provides frequency subband information that represents spectral components of the audio signal. Information representing spectral components of a baseband signal is generated along the path 12 and information representing spectral components of a residual signal are generated along the path 11. The spectral components of the baseband signal represent the spectral content of the input audio signal in one or more subbands in a first set of frequency subbands, which are represented by signal information conveyed in the encoded signal. In a preferred implementation, the first set of frequency subbands are the lower-frequency subbands. The spectral components of the residual signal represent the spectral content of the input audio signal in one or more subbands in a second set of frequency subbands, which are not represented in the baseband signal and are not conveyed by the encoded signal. In one implementation, the union of the first and second sets of frequency subbands constitute the entire bandwidth of the input audio signal.

The energy calculator 31 calculates one or more measures of spectral energy in one or more frequency subbands of the residual signal. In a preferred implementation, the spectral components received from the path 11 are arranged in frequency subbands having bandwidths commensurate with the critical bands of the human auditory system and the energy calculator 31 provides an energy measure for each of these frequency subbands.

The synthesis model 21 represents a signal synthesis process that will take place in a decoding process that will be used to decode the encoded signal generated along the path 51. The synthesis model 21 may carry out the synthesis process itself or it may perform some other process that can estimate the spectral energy of the synthesized signal without actually performing the synthesis process. The energy calculator 32 receives the output of the synthesis model 21 and calculates one or more measures of spectral energy in the signal to be synthesized. In a preferred implementation, spectral components of the synthesized signal are arranged in frequency subbands having bandwidths commensurate with the critical bands of the human auditory system and the energy calculator 32 provides an energy measure for each of these frequency subbands.

Figure 5:
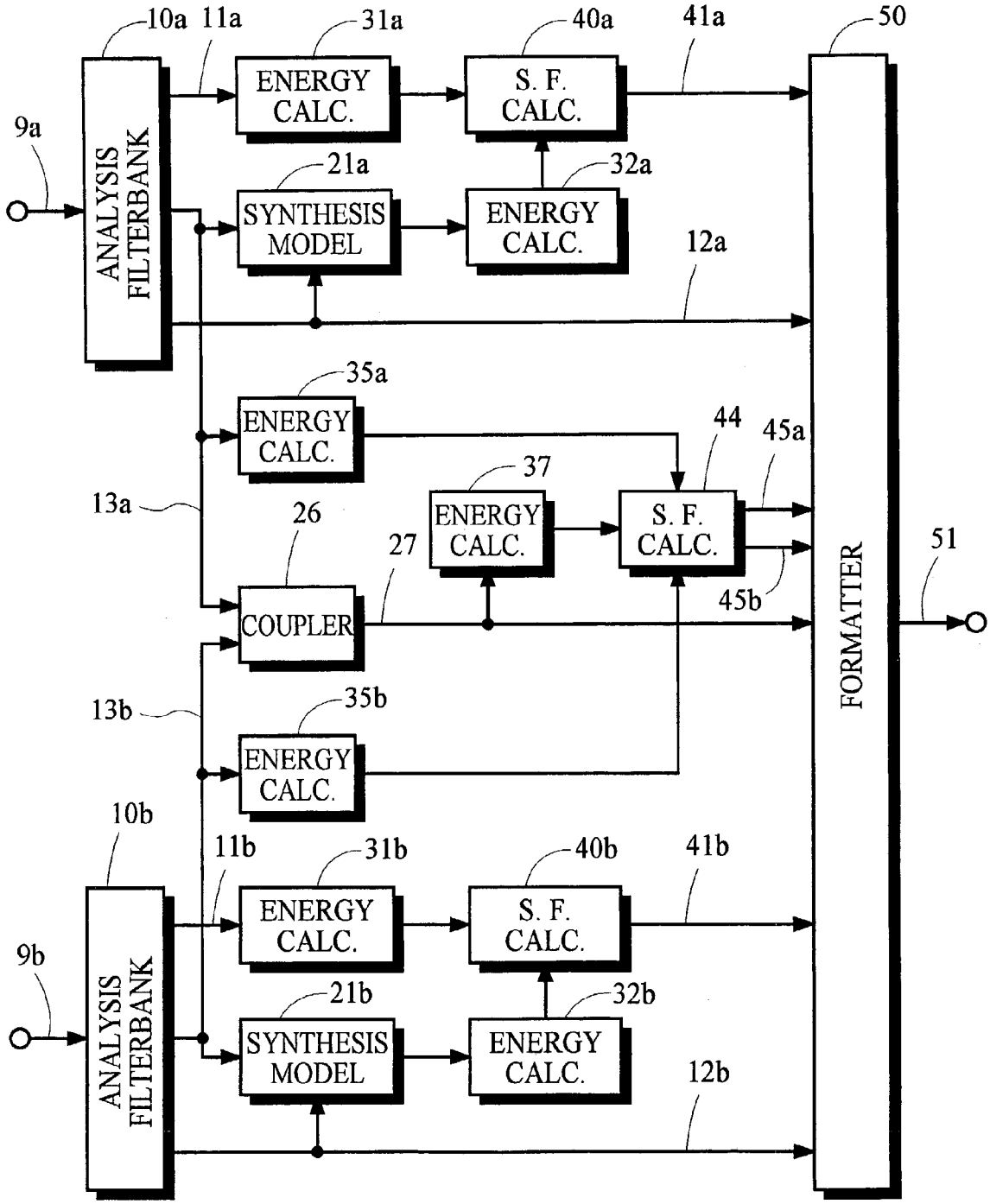
FIGS. 5 and 6 are schematic block diagrams of devices that encode an audio signal using coupling for subsequent decoding by a device using high-frequency regeneration and decoupling.
Figure 6:
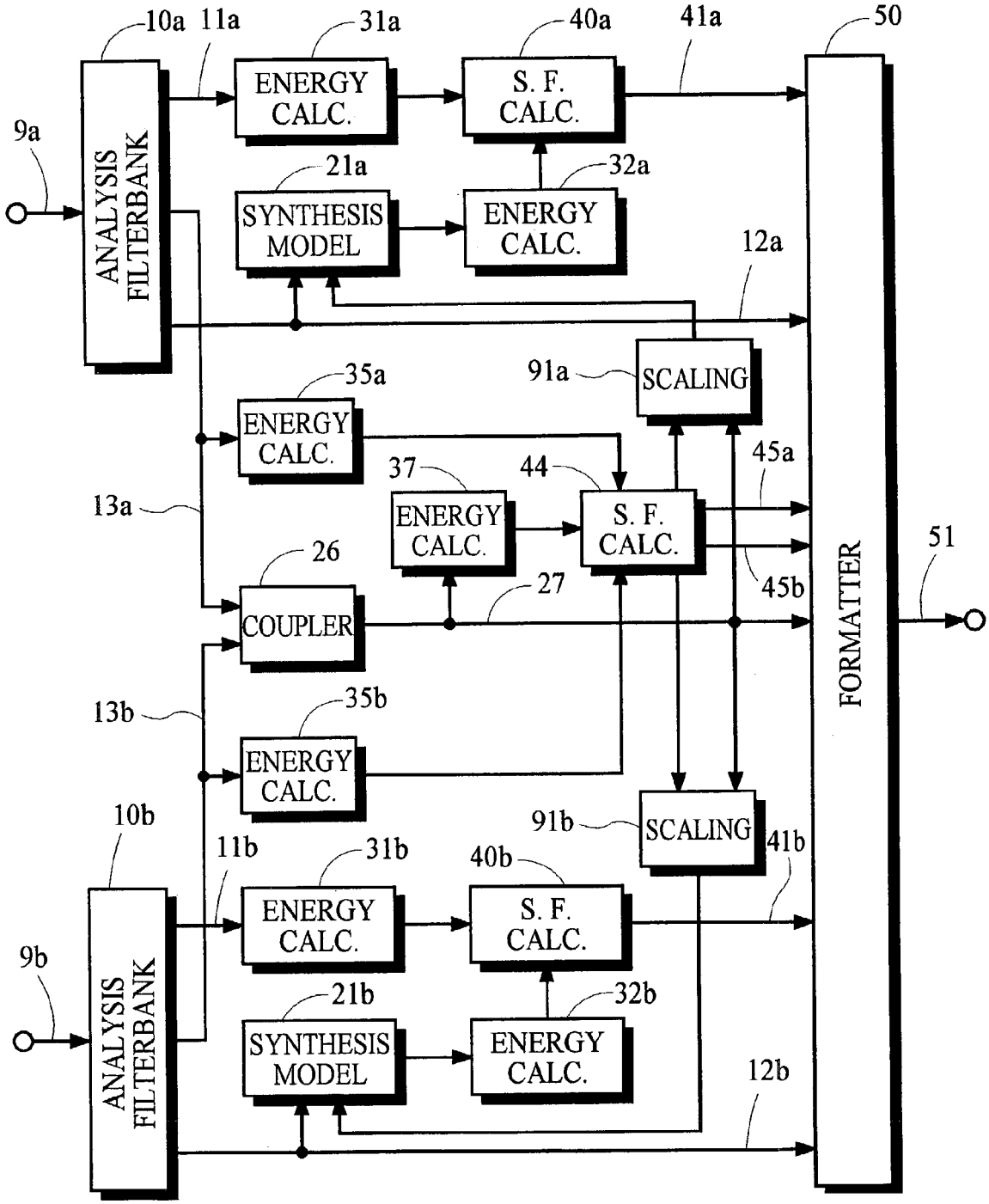
Figure 8:
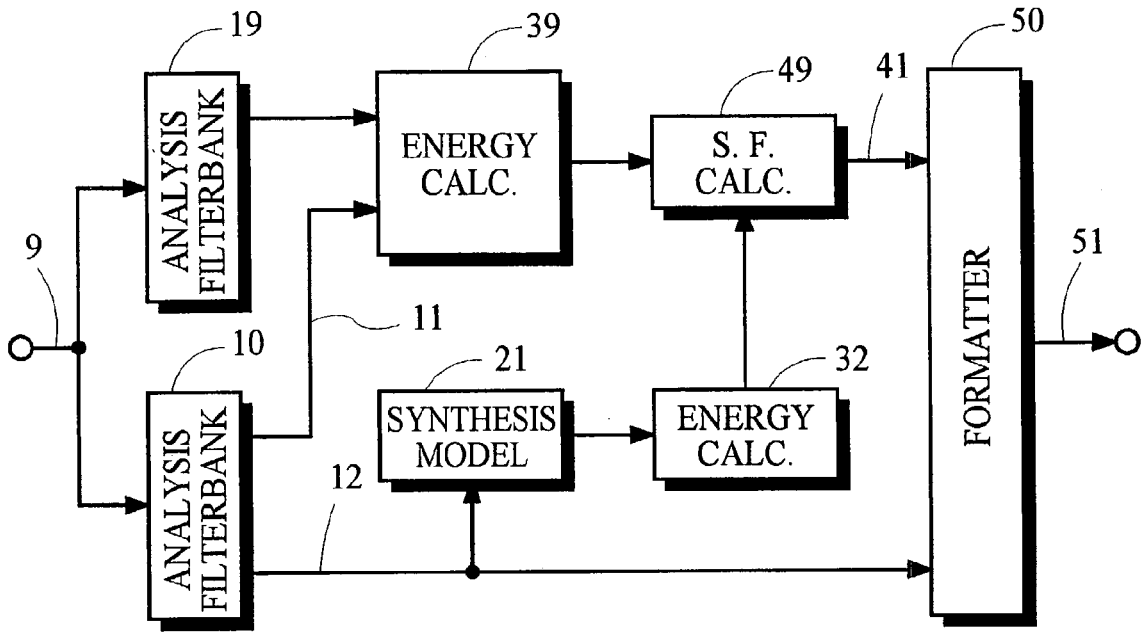
FIG. 8 is a schematic block diagram of a device for encoding an audio signal that uses a second analysis filterbank to provide additional spectral components for energy calculations.

The illustration in FIG. 1 as well as the illustrations in FIGS. 5, 6 and 8 show connections between the analysis filterbank and the synthesis model that suggests the synthesis model responds at least in part to the baseband signal; however, this connection is optional. A few implementations of the synthesis model are discussed below. Some of these implementations operate independently of the baseband signal.

The scale factor calculator 40 receives one or more energy measures from each of the two energy calculators and calculates scale factors as explained in more detail below. Scaling information representing the calculated scale factors is passed along the path 41.

The formatter 50 receives the scaling information from the path 41 and receives from the path 12 information representing the spectral components of the baseband signal. This information is assembled into an encoded signal, which is passed along the path 51 for transmission or for recording. The encoded signal may be transmitted by baseband or modulated communication paths throughout the spectrum including from supersonic to ultraviolet frequencies, or it may be recorded on media using essentially any recording technology including magnetic tape, cards or disk, optical cards or disc, and detectable markings on media like paper.

In preferred implementations, the spectral components of the baseband signal are encoded using perceptual encoding processes that reduce information capacity requirements by discarding portions that are either redundant or irrelevant. These encoding processes are not essential to the present invention.

2. Decoder

Figure 2:
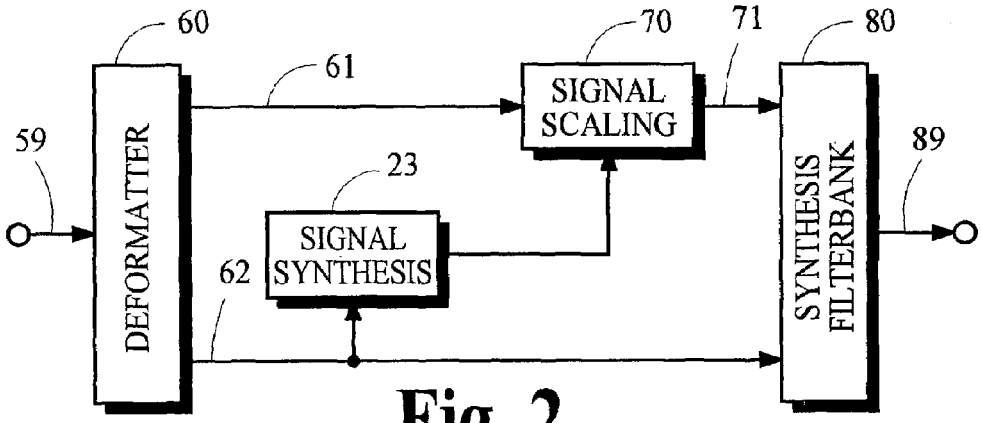
FIG. 2 is a schematic block diagram of a device that decodes an encoded audio signal using high-frequency regeneration.

FIG. 2 illustrates an audio decoder that receives an encoded signal representing an audio signal and generates a decoded representation of the audio signal. The deformatter 60 receives the encoded signal from the path 59 and obtains scaling information and signal information from the encoded signal. The scaling information represents scale factors and the signal information represents spectral components of a baseband signal that has spectral components in one or more subbands in a first set of frequency subbands. The signal synthesis component 23 carries out a synthesis process to generate a signal having spectral components in one or more subbands in a second set of frequency subbands that represent spectral components of a residual signal that was not conveyed by the encoded signal.

Figure 7:
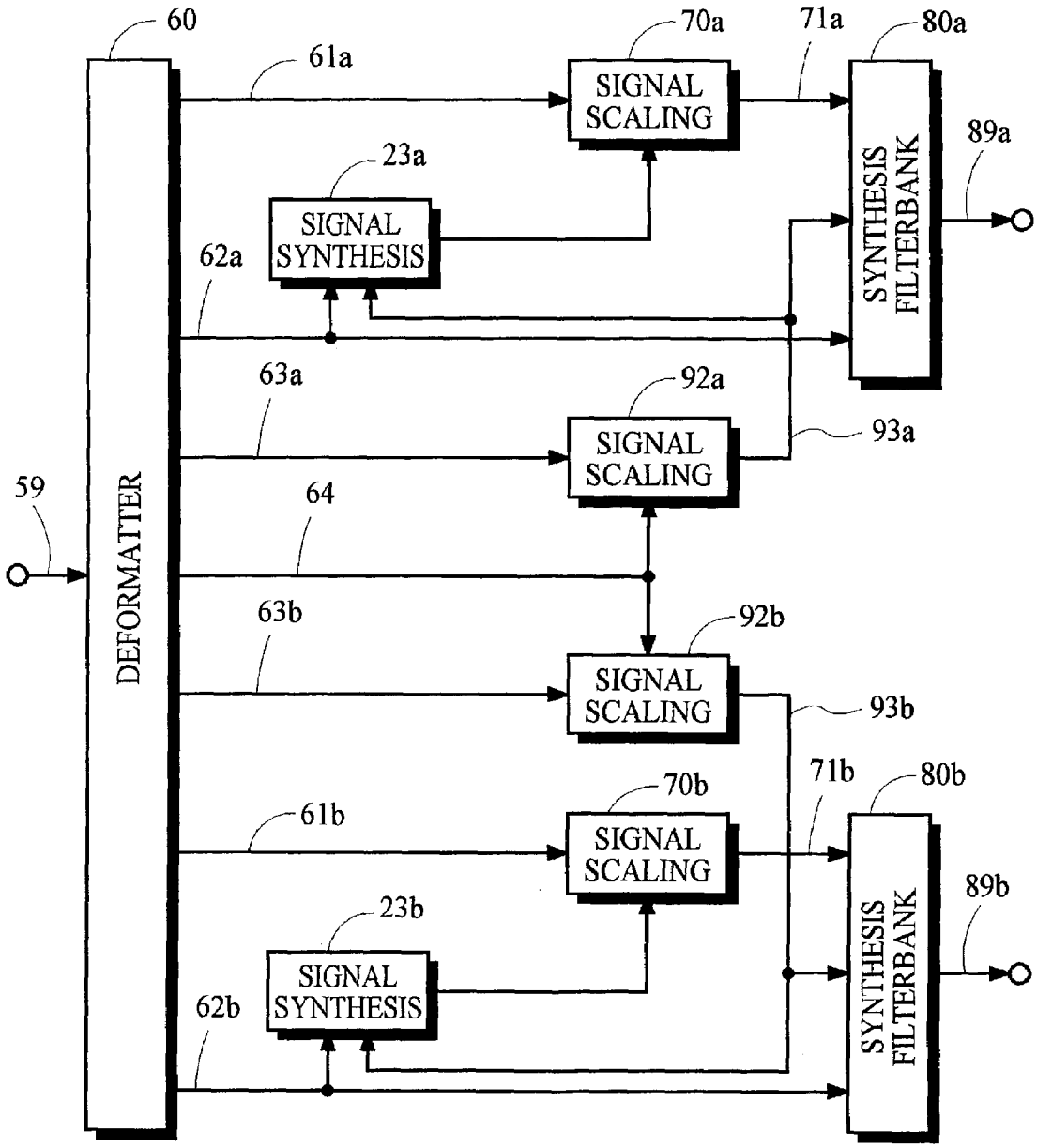
FIG. 7 is a schematic block diagram of a device that decodes an encoded audio signal using high-frequency regeneration and decoupling.

The illustration in FIGS. 2 and 7 show a connection between the deformatter and the signal synthesis component 23 that suggests the signal synthesis responds at least in part to the baseband signal; however, this connection is optional. A few implementations of signal synthesis are discussed below. Some of these implementations operate independently of the baseband signal.

The signal scaling component 70 obtains scale factors from the scaling information received from the path 61. The scale factors are used to scale the spectral components of the synthesized signal generated by the signal synthesis component 23. The synthesis filterbank 80 receives the scaled synthesized signal from the path 71, receives the spectral components of the baseband signal from the path 62, and generates in response along the path 89 an output audio signal that is a decoded representation of the original input audio signal. Although the output signal is not identical to the original input audio signal, it is anticipated that the output signal is either perceptually indistinguishable from the input audio signal or is at least distinguishable in a way that is perceptually pleasing and acceptable for a given application.

In preferred implementations, the signal information represents the spectral components of the baseband signal in an encoded form that must be decoded using a decoding process that is inverse to the encoding process used in the encoder. As mentioned above, these processes are not essential to the present invention.

3. Filterbanks

The analysis and synthesis filterbanks may be implemented in essentially any way that is desired including a wide range of digital filter technologies, block transforms and wavelet transforms. In one audio coding system having an encoder and a decoder like those shown in FIGS. 1 and 2, respectively, the analysis filterbank 10 is implemented by a Modified Discrete Cosine Transform (MDCT) and the synthesis filterbank 80 is implemented by a modified Inverse Discrete Cosine Transform that are described in Princen et al., "Subband/Transform Coding Using Filter Bank Designs Based on Time Domain Aliasing Cancellation," *Proc. of the International Conf. on Acoust., Speech and Signal Proc.*, May 1987, pp. 2161-64. No particular filterbank implementation is important in principle.

Analysis filterbanks that are implemented by block transforms split a block or interval of an input signal into a set of transform coefficients that represent the spectral content of that interval of signal. A group of one or more adjacent transform coefficients represents the spectral content within a particular frequency subband having a bandwidth commensurate with the number of coefficients in the group.

Analysis filterbanks that are implemented by some type of digital filter such as a polyphase filter, rather than a block transform, split an input signal into a set of subband signals. Each subband signal is a time-based representation of the spectral content of the input signal within a particular frequency subband. Preferably, the subband signal is decimated so that each subband signal has a bandwidth that is commensurate with the number of samples in the subband signal for a unit interval of time.

The following discussion refers more particularly to implementations that use block transforms like the Time Domain Aliasing Cancellation (TDAC) transform mentioned above. In this discussion, the term "spectral components" refers to the transform coefficients and the terms "frequency subband" and "subband signal" pertain to groups of one or more adjacent transform coefficients. Principles of the present invention may be applied to other types of implementations, however, so the terms "frequency subband" and "subband signal" pertain also to a signal representing spectral content of a portion of the whole bandwidth of a signal, and the term "spectral components" generally may be understood to refer to samples or elements of the subband signal.

B. Scale Factors

In coding systems using a transform like the TDAC transform, for example, transform coefficients X(k) represent spectral components of an original input audio signal x(t). The transform coefficients are divided into different sets representing a baseband signal and a residual signal. Transform coefficients Y(k) of a synthesized signal are generated during the decoding process using a synthesis process such as one of those described below.

1. Calculation

In a preferred implementation, the encoding process provides scaling information that conveys scale factors calculated from the square root of a ratio of a spectral energy measure of the residual signal to a spectral energy measure of the synthesized signal. Measures of spectral energy for the residual signal and the synthesized signal may be calculated from the expressions $$E(k)=X^2(k) \tag{1a}$$

$$ES(k)=Y^2(k) \tag{1b}$$

where

X(k)=transform coefficient k in the residual signal;

E(k)=energy measure of spectral component X(k);

Y(k)=transform coefficient k in the synthesized signal; and

ES(k)=energy measure of spectral component Y(k).

The information capacity requirements for side information that is based on energy measures for each spectral component is too high for most applications; therefore, scale factors are calculated from energy measures of groups or frequency subbands of spectral components according to the expressions $$E(m) = \sum_{k=ml}^{m2} X^2(k) \tag{2a}$$

$$ES(m) = \sum_{k=ml}^{m2} Y^2(k) \tag{2b}$$

where

E(m)=energy measure for frequency subband m of the residual signal; and

ES(m)=energy measure for frequency subband m of the synthesized signal.

The limits of summation m1 and m2 specify the lowest and highest frequency spectral components in subband m. In preferred implementations, the frequency subbands have bandwidths commensurate with the critical bands of the human auditory system.

The limits of summation may also be represented using a set notation such as $k\epsilon\{M\}$ where {M} represents the set of all spectral components that are included in the energy calculation. This notation is used throughout the remainder of this description for reasons that are explained below. Using this notation, expressions 2a and 2b may be written as shown in expressions 2c and 2d, respectively, $$E(m) = \sum_{k\in[M]} X^2(k) \tag{2c}$$

$$ES(m) = \sum_{k\in[M]} Y^2(k) \tag{2d}$$

where

{M}=set of all spectral components in subband m.

The scale factor SF(m) for subband m may be calculated from either of the following expressions $$SF(m) = \sqrt{\frac{E(m)}{ES(m)}} \tag{3a}$$

$$SF(m) = \frac{\sqrt{E(m)}}{\sqrt{ES(m)}} \tag{3b}$$

but a calculation based on the first expression is usually more efficient.

2. Representation of Scale Factors

Preferably, the encoding process provides scaling information in the encoded signal that conveys the calculated scale factors in a form that requires a lower information capacity than these scale factors themselves. A variety of methods may be used to reduce the information capacity requirements of the scaling information.

One method represents each scale factor itself as a scaled number with an associated scaling value. One way in which this may be done is to represent each scale factor as a floating-point number in which a mantissa is the scaled number and an associated exponent represents the scaling value. The precision of the mantissas or scaled numbers can be chosen to convey the scale factors with sufficient accuracy. The allowed range of the exponents or scaling values can be chosen to provide a sufficient dynamic range for the scale factors. The process that generates the scaling information may also allow two or more floating-point mantissas or scaled numbers to share a common exponent or scaling value.

Another method reduces information capacity requirements by normalizing the scale factors with respect to some base value or normalizing value. The base value may be specified in advance to the encoding and decoding processes of the scaling information, or it may be determined adaptively. For example, the scale factors for all frequency subbands of an audio signal may be normalized with respect to the largest of the scale factors for an interval of the audio signal, or they may be normalized with respect to a value that is selected from a specified set of values. Some indication of the base value is included with the scaling information so that the decoding process can reverse the effects of the normalization.

The processing needed to encode and decode the scaling information can be facilitated in many implementations if the scale factors can be represented by values that are within a range from zero to one. This range can be assured if the scale factors are normalized with respect to some base value that is equal to or larger than all possible scale factors. Alternatively, the scale factors can be normalized with respect to some base value larger than any scale factor that can be reasonably expected and set equal to one if some unexpected or rare event causes a scale factor to exceed this value. If the base value is restrained to be a power of two, the processes that normalize the scale factors and reverse the normalization can be implemented efficiently by binary integer arithmetic functions or binary shift operations.

More than one of these methods may be used together. For example, the scaling information may include floating-point representations of normalized scale factors.

C. Signal Synthesis

The synthesized signal may be generated in a variety of ways.

1. Frequency Translation

One technique generates spectral components Y(k) of the synthesized signal by linearly translating spectral components X(k) of a baseband signal. This translation may be expressed as $$Y(j)=X(k) \tag{4}$$

where the difference (j−k) is the amount of frequency translation for spectral component k.

When spectral components in subband m are translated into frequency subband p, the encoding process may calculate a scale factor for frequency subband p from an energy measure of spectral components in frequency subband m according to the expression $$SF(p)=\sqrt{\frac{E(p)}{ES(p)}}=\sqrt{\frac{\sum_{j\in\{P\}}X^2(j)}{\sum_{j\in\{P\}}Y^2(j)}}=\sqrt{\frac{\sum_{j\in\{P\}}X^2(j)}{\sum_{k\in\{M\}}X^2(k)}} \tag{5}$$

where

{P}=set of all spectral components in frequency subband p; and

{M}=set of spectral components in frequency subband m that are translated.

The set {M} is not required to contain all spectral components in frequency subband m and some of the spectral components in frequency subband m may be represented in the set more than once. This is because the frequency translation process may not translate some spectral components in frequency subband m and may translate other spectral components in frequency subband m more than once by different amounts each time. Either or both of these situations will occur when frequency subband p does not have the same number of spectral components as frequency subband m.

The following example illustrates a situation in which some spectral components in a subband m are omitted and others are represented more than once. The frequency extent of frequency subband m is from 200 Hz to 3.5 kHz and the frequency extent of frequency subband p is from 10 kHz to 14 kHz. A signal is synthesized in frequency subband p by translating spectral components from 500 Hz to 3.5 kHz into the range from 10 kHz to 13 kHz, where the amount of translation for each spectral component is 9.5 kHz, and by translating the spectral components from 500 Hz to 1.5 kHz into the range 13 kHz to 14 kHz, where the amount of translation for each spectral component is 12.5 kHz. The set {M} in this example would not include any spectral component from 200 Hz to 500 Hz, but would include the spectral components from 1.5 kHz to 3.5 kHz and would include two occurrences of each spectral component from 500 Hz to 1.5 kHz.

The HFR application mentioned above describes other considerations that may be incorporated into a coding system to improve the perceived quality of the synthesized signal. One consideration is a feature that modifies translated spectral components as necessary to ensure a coherent phase is maintained in the translated signal. In preferred implementations of the present invention, the amount of frequency translation is restricted so that the translated components maintain a coherent phase without any further modification. For implementations using the TDAC transform, for example, this can be achieved by ensuring the amount of translation is an even number.

Another consideration is the noise-like or tone-like character of an audio signal. In many situations, the higher-frequency portion of an audio signal is more noise like than the lower-frequency portion. If a low-frequency baseband signal is more tone like and a high-frequency residual signal is more noise like, frequency translation will generate a high-frequency synthesized signal that is more tone-like than the original residual signal. The change in the character of the high-frequency portion of the signal can cause an audible degradation, but the audibility of the degradation can be reduced or avoided by a synthesis technique described below that uses frequency translation and noise generation to preserve the noise-like character of the high-frequency portion.

In other situations when the lower-frequency and higher-frequency portions of a signal are both tone like, frequency translation may still cause an audible degradation because the translated spectral components do not preserve the harmonic structure of the original residual signal. The audible effects of this degradation can be reduced or avoided by restricting the lowest frequency of the residual signal to be synthesized by frequency translation. The HFR application suggests the lowest frequency for translation should be no lower than about 5 kHz.

2. Noise Generation

A second technique that may be used to generate the synthesized signal is to synthesize a noise-like signal such as by generating a sequence of pseudo-random numbers to represent the samples of a time-domain signal. This particular technique has the disadvantage that an analysis filterbank must be used to obtain the spectral components of the generated signal for subsequent signal synthesis. Alternatively, a noise-like signal can be generated by using a pseudo-random number generator to directly generate the spectral components. Either method may be represented schematically by the expression $$Y(j)=N(j) \tag{6}$$

where N(j)=spectral component j of the noise-like signal.

With either method, however, the encoding process synthesizes the noise-like signal. The additional computational resources required to generate this signal increases the complexity and implementation costs of the encoding process.

3. Translation and Noise

A third technique for signal synthesis is to combine a frequency translation of the baseband signal with the spectral components of a synthesized noise-like signal. In a preferred implementation, the relative portions of the translated signal and the noise-like signal are adapted as described in the BFR application according to noise-blending control information that is conveyed in the encoded signal. This technique may be expressed as $$Y(j)=a\cdot X(k)+b\cdot N(j) \tag{7}$$

where a=blending parameter for the translated spectral component; and b=blending parameter for the noise-like spectral component.

In one implementation, the blending parameter b is calculated by taking the square root of a Spectral Flatness Measure (SFM) that is equal to a logarithm of the ratio of the geometric mean to the arithmetic mean of spectral component values, which is scaled and bounded to vary within a range from zero to one. For this particular implementation, b=1 indicates a noise-like signal. Preferably, the blending parameter a is derived from b as shown in the following expression $$a=\sqrt{c-b^2} \tag{8}$$

where c is a constant.

In a preferred implementation, the constant c in expression 8 is equal to one and the noise-like signal is generated such that its spectral components N(j) have a mean value of zero and energy measures that are statistically equivalent to the energy measures of the translated spectral components with which they are combined. The synthesis process can blend the spectral components of the noise-like signal with the translated spectral components as shown above in expression 7. The energy of frequency subband p in this synthesized signal may be calculated from the expression $$ES(p) = \sum_{\{j \in \{P\}} Y^2(j) = \sum_{k \in \{M\}, (j \in \{P\}} [a \cdot X(k) + b \cdot N(j)]^2 \quad (9)$$

In an alternative implementation, the blending parameters represent specified functions of frequency or they expressly convey functions of frequency a(j) and b(j) that indicate how the noise-like character of the original input audio signal varies with frequency. In yet another alternative, blending parameters are provided for individual frequency subbands, which are based on noise measures that can be calculated for each subband.

The calculation of energy measures for the synthesized signal are performed by both the encoding and decoding processes. Calculations that include spectral components of the noise-like signal are undesirable because the encoding process must use additional computational resources to synthesize the noise-like signal only for the purpose of performing these energy calculations. The synthesized signal itself is not needed for any other purpose by the encoding process.

The preferred implementation described above allows the encoding process to obtain an energy measure of the spectral components of the synthesized signal shown in expression 7 without synthesizing the noise-like signal because the energy of a frequency subband of the spectral components in the synthesized signal is statistically independent of the spectral energy of the noise-like signal. The encoding process can calculate an energy measure based only on the translated spectral components. An energy measure that is calculated in this manner will, on the average, be an accurate measure of the actual energy. As a result, the encoding process may calculate a scale factor for frequency subband p from only an energy measure of frequency subband m of the baseband signal according to expression 5.

In an alternative implementation, spectral energy measures are conveyed by the encoded signal rather than scale factors. In this alternative implementation, the noise-like signal is generated so that its spectral components have a mean equal to zero and a variance equal to one, and the translated spectral components are scaled so that their variance is one. The spectral energy of the synthesized signal that is obtained by combining components as shown in expression 7 is, on average, equal to the constant c. The decoding process can scale this synthesized signal to have the same energy measures as the original residual signal. If the constant c is not equal to one, the scaling process should also account for this constant.

D. Coupling

Reductions in the information requirements of an encoded signal may be achieved for a given level of perceived signal quality in the decoded signal by using coupling in coding systems that generate an encoded signal representing two or more channels of audio signals.

1. Encoder

FIGS. 5 and 6 illustrate audio encoders that receive two channels of input audio signals from the paths 9*a* and 9*b*, and generate along the path 51 an encoded signal representing the two channels of input audio signals. Details and features of the analysis filterbanks 10*a* and 10*b*, the energy calculators 31*a*, 32*a*, 31*b* and 32*b*, the synthesis models 21*a* and 21*b*, the scale factor calculators 40*a* and 40*b*, and the formatter 50 are essentially the same as those described above for the components of the single-channel encoder illustrated in FIG. 1.

a) Common Features

The encoders illustrated in FIGS. 5 and 6 are similar. Features that are common to the two implementations are described before the differences are discussed.

Referring to FIGS. 5 and 6, the analysis filterbanks 10*a* and 10*b* generate spectral components along the paths 13*a* and 13*b*, respectively, that represent spectral components of a respective input audio signal in one or more subbands in a third set of frequency subbands. In a preferred implementation, the third set of frequency subbands are one or more middle-frequency subbands that are above low-frequency subbands in the first set of frequency subbands and are below high-frequency subbands in the second set of frequency subbands. The energy calculators 35*a* and 35*b* each calculate one or more measures of spectral energy in one or more frequency subbands. Preferably, these frequency subbands have bandwidths that are commensurate with the critical bands of the human auditory system and the energy calculators 35*a* and 35*b* provide an energy measure for each of these frequency subbands.

The coupler 26 generates along the path 27 a coupled-channel signal having spectral components that represent a composite of the spectral components received from the paths 13*a* and 13*b*. This composite representation may be formed in a variety of ways. For example, each spectral component in the composite representation may be calculated from the sum or the average of corresponding spectral component values received from the paths 13*a* and 13*b*. The energy calculator 37 calculates one or more measures of spectral energy in one or more frequency subbands of the coupled-channel signal. In a preferred implementation, these frequency subbands have bandwidths that are commensurate with the critical bands of the human auditory system and the energy calculator 37 provides an energy measure for each of these frequency subbands.

The scale factor calculator 44 receives one or more energy measures from each of the energy calculators 35*a*, 35*b* and 37 and calculates scale factors as explained above. Scaling information representing the scale factors for each input audio signal that is represented in the coupled-channel signal is passed along the paths 45*a* and 45*b*, respectively. This scaling information may be encoded as explained above. In a preferred implementation, a scale factor is calculated for each input channel signal in each frequency subband as represented by either of the following expressions $$SF_i(m) = \sqrt{\frac{E_i(m)}{EC(m)}} \quad (10a)$$

$$SF_i(m) = \frac{\sqrt{E_i(m)}}{\sqrt{EC(m)}} \quad (10b)$$

where $SF_i(m)$=scale factor for frequency subband m of signal channel i;

$E_i(m)$=energy measure for frequency subband m of input signal channel i; and

EC(m)=energy measure for frequency subband m of the coupled-channel.

The formatter 50 receives scaling information from the paths 41*a*, 41*b*, 45*a* and 45*b*, receives information representing spectral components of baseband signals from the paths 12*a* and 12*b*, and receives information representing spectral components of the coupled-channel signal from the path 27. This information is assembled into an encoded signal as explained above for transmission or recording.

The encoders shown in FIGS. 5 and 6 as well as the decoder shown in FIG. 7 are two-channel devices; however, various aspects of the present invention may be applied in coding systems for a larger number of channels. The descriptions and drawings refer to two channel implementations merely for convenience of explanation and illustration.

b) Different Features

Spectral components in the coupled-channel signal may be used in the decoding process for HFR. In such implementations, the encoder should provide control information in the encoded signal for the decoding process to use in generating synthesized signals from the coupled-channel signal. This control information may be generated in a number of ways.

One way is illustrated in FIG. 5. According to this implementation, the synthesis model 21*a* is responsive to baseband spectral components received from the path 12*a* and is responsive to spectral components received from the path 13*a* that are to be coupled by the coupler 26. The synthesis model 21*a*, the associated energy calculators 31*a* and 32*a*, and the scale factor calculator 40*a* perform calculations in a manner that is analogous to the calculations discussed above. Scaling information representing these scale factors is passed along the path 41*a* to the formatter 50. The formatter also receives scaling information from the path 41*b* that represents scale factors calculated in a similar manner for spectral components from the paths 12*b* and 13*b*.

In an alternative implementation of the encoder shown in FIG. 5, the synthesis model 21*a* operates independently of the spectral components from either one or both of the paths 12*a* and 13*a*, and the synthesis model 21*b* operates independently of the spectral components from either one or both of the paths 12*b* and 13*b*, as discussed above.

In yet another implementation, scale factors for HFR are not calculated for the coupled-channel signal and/or the baseband signals. Instead, a representation of spectral energy measures are passed to the formatter 50 and included in the encoded signal rather than a representation of the corresponding scale factors. This implementation increases the computational complexity of the decoding process because the decoding process must calculate at least some of the scale factors; however, it does reduce the computational complexity of the encoding process.

Another way to generate the control information is illustrated in FIG. 6. According to this implementation, the scaling components 91*a* and 91*b* receive the coupled-channel signal from the path 27 and scale factors from the scale factor calculator 44, and perform processing equivalent to that performed in the decoding process, discussed below, to generate decoupled signals from the coupled-channel signal. The decoupled signals are passed to the synthesis models 21*a* and 21*b*, and scale factors are calculated in a manner analogous to that discussed above in connection with FIG. 5.

In an alternative implementation of the encoder shown in FIG. 6, the synthesis models 21*a* and 21*b* may operate independently of the spectral components for the baseband signals and/or the coupled-channel signal if these spectral components are not required for calculation of the spectral energy measures and scale factors. In addition, the synthesis models may operate independently of the coupled-channel signal if spectral components in the coupled-channel signal are not used for HFR.

2. Decoder

FIG. 7 illustrates an audio decoder that receives an encoded signal representing two channels of input audio signals from the path 59 and generates along the paths 89*a* and 89*b* decoded representations of the signals. Details and features of the deformatter 60, the signal synthesis components 23*a* and 23*b*, the signal scaling components 70*a* and 70*b*, and the synthesis filterbanks 80*a* and 80*b* are essentially the same as those described above for the components of the single-channel decoder illustrated in FIG. 2.

The deformatter 60 obtains from the encoded signal a coupled-channel signal and a set of coupling scale factors. The coupled-channel signal, which has spectral components that represent a composite of spectral components in the two input audio signals, is passed along the path 64. The coupling scale factors for each of the two input audio signals are passed along the paths 63*a* and 63*b*, respectively.

The signal scaling component 92*a* generates along the path 93*a* the spectral components of a decoupled signal that approximate the spectral energy levels of corresponding spectral components in one of the original input audio signals. These decoupled spectral components can be generated by multiplying each spectral component in the coupled-channel signal by an appropriate coupling scale factor. In implementations that arrange spectral components of the coupled-channel signal into frequency subbands and provide a scale factor for each subband, the spectral components of a decoupled signal may be generated according to the expression $$XD_i(k)=SF_i(m)\cdot XC(k) \quad (11)$$

where

XC(k)=spectral component k in subband m of the coupled-channel signal;

$SF_i(m)$=scale factor for frequency subband m of signal channel i; and $XD_i(k)$=decoupled spectral component k for signal channel i.

Each decoupled signal is passed to a respective synthesis filterbank. In the preferred implementation described above, the spectral components of each decoupled signal are in one or more subbands in a third set of frequency subbands that are intermediate to the frequency subbands of the first and second sets of frequency subbands.

Decoupled spectral components are also passed to a respective signal synthesis component 23*a* or 23*b* if they are needed for signal synthesis.

E. Adaptive Banding

Coding systems that arrange spectral components into either two or three sets of frequency subbands as discussed above may adapt the frequency ranges or extents of the subbands that are included in each set. It can be advantageous, for example, to decrease the lower end of the frequency range of the second set of frequency subbands for the residual signal during intervals of an input audio signal that have high-frequency spectral components that are deemed to be noise like. The frequency extents may also be adapted to remove all subbands in a set of frequency subbands. For example, the HFR process may be inhibited for input audio signals that have large, abrupt changes in amplitude by removing all subbands from the second set of frequency subbands.

Figure 3:
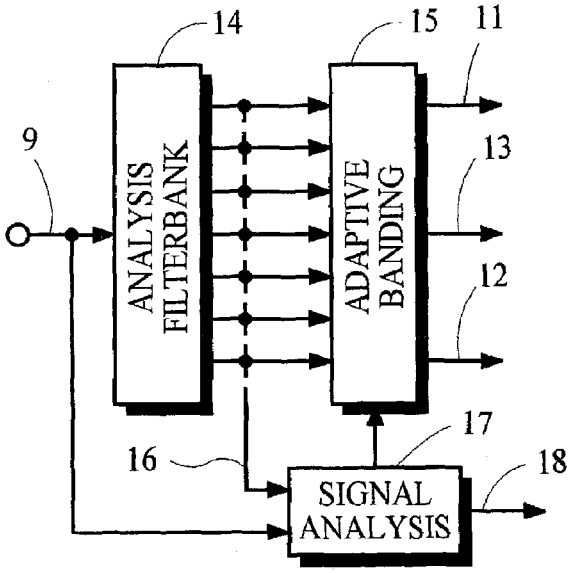
FIG. 3 is a schematic block diagram of a device that splits an audio signal into frequency subband signals having extents that are adapted in response to one or more characteristics of the audio signal.
Figure 4:
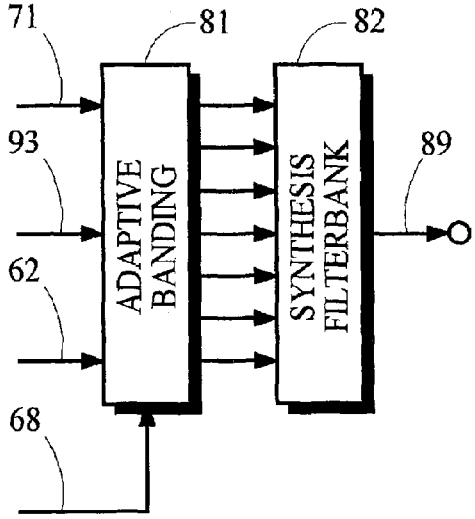
FIG. 4 is a schematic block diagram of a device that synthesizes an audio signal from frequency subband signals having extents that are adapted.

FIGS. 3 and 4 illustrate a way in which the frequency extents of the baseband, residual and/or coupled-channel signals may be adapted for any reason including a response to one or more characteristics of an input audio signal. To implement this feature, each of the analysis filterbanks shown in FIGS. 1, 5, 6 and 8 may be replaced by the device shown in FIG. 3 and each of the synthesis filterbanks shown in FIGS. 2 and 7 may be replaced by the device shown in FIG. 4. These figures show how frequency subbands may be adapted for three sets of frequency subbands; however, the same principles of implementation may be used to adapt a different number of sets of subbands.

Referring to FIG. 3, the analysis filterbank 14 receives an input audio signal from the path 9 and generates in response a set of frequency subband signals that are passed to the adaptive banding component 15. The signal analysis component 17 analyzes information derived directly from the input audio signal and/or derived from the subband signals and generates band control information in response to this analysis. The band control information is passed to the adaptive banding component 15, and it passes the band control information along the path 18 to the formatter 50. The formatter 50 includes a representation of this band control information in the encoded signal.

The adaptive banding component 15 responds to the band control information by assigning the subband signal spectral components to sets of frequency subbands. Spectral components assigned to the first set of subbands are passed along the path 12. Spectral components assigned to the second set of subbands are passed along the path 11. Spectral components assigned to the third set of subbands are passed along the path 13. If there is a frequency range or gap that is not included in any of the sets, this may be achieved by not assigning spectral components in this range or gap to any of the sets.

The signal analysis component 17 may also generate band control information to adapt the frequency extents in response to conditions unrelated to the input audio signal. For example, extents may be adapted in response to a signal that represents a desired level of signal quality or the available capacity to transmit or record the encoded signal.

The band control information may be generated in many forms. In one implementation, the band control information specifies the lowest and/or the highest frequency for each set into which spectral components are to be assigned. In another implementation, the band control information specifies one of a plurality of predefined arrangements of frequency extents.

Referring to FIG. 4, the adaptive banding component 81 receives sets of spectral components from the paths 71, 93 and 62, and it receives band control information from the path 68. The band control information is obtained from the encoded signal by the deformatter 60. The adaptive banding component 81 responds to the band control information by distributing the spectral components in the received sets of spectral components into a set of frequency subband signals, which are passed to the synthesis filterbank 82. The synthesis filterbank 82 generates along the path 89 an output audio signal in response to the frequency subband signals.

F. Second Analysis Filterbank

The measures of spectral energy that are calculated from expression 1a in audio encoders that implement the analysis filterbank 10 with a transform such as the TDAC transform mentioned above, for example, tend to be lower than the true spectral energy of the input audio signal because the analysis filterbank provides only real-valued transform coefficients. Implementations that use transforms like the Discrete Fourier Transform (DFT) are able to provide more accurate energy calculations because each transform coefficient is represented by a complex value that more accurately conveys the true magnitude of each spectral component.

The inherent inaccuracy of energy calculations based on transform coefficients with only real values from transforms like the TDAC transform can be overcome by using a second analysis filterbank with basis functions that are orthogonal to the basis functions of the analysis filterbank 10. FIG. 8 illustrates an audio encoder that is similar to the encoder shown in FIG. 1 but includes a second analysis filterbank 19. If the encoder uses the MDCT of the TDAC transform to implement the analysis filterbank 10, a corresponding Modified Discrete Sine Transform (MDST) can be used to implement the second analysis filterbank 19.

The energy calculator 39 calculates more accurate measures of spectral energy E'(k) from the expression $$E'(k)=X_1^2(k)+X_2^2(k) \tag{12}$$

where $X_1(k)$=transform coefficient k from the first analysis filterbank; and $X_2(k)$=transform coefficient k from the second analysis filterbank. In implementations that calculate measures of energy for frequency subbands, the energy calculator 39 calculates the measures for a frequency subband m from the expression $$E'(m) = \sum_{k\in\{M\}} X_1^2(k) + X_2^2(k) \tag{13}$$

The scale factor calculator 49 calculates scale factors SF'(m) from these more accurate measures of energy in a manner that is analogous to expressions 3a or 3b. An analogous calculation to expression 3a is shown in expression 14.

$$SF'(m) = \sqrt{\frac{E'(m)}{ES(m)}} = \sqrt{\frac{\sum_{k\in\{M\}} X_1^2(k) + X_2^2(k)}{\sum_{k\in\{M\}} Y^2(k)}} \quad (14)$$

Some care should be taken when using the scale factors SF'(m) that are calculated from these more accurate measures of energy. Spectral components of the synthesized signal that are scaled according to the more accurate scale factors SF'(m) will almost certainly distort the relative spectral balance of the baseband portion of a signal and the regenerated synthesized portion because the more accurate energy measures will always be greater than or equal to the energy measures calculated from only the real-valued transform coefficients. One way in which this difference can be compensated is to reduce the more accurate energy measurement by half because, on the average, the more accurate measure will be twice as large as the less accurate measure. This reduction will provide a statistically consistent level of energy in the baseband and synthesized portions of a signal while retaining the benefit of a more accurate measure of spectral energy.

It may be useful to point out that the denominator of the ratio in expression 14 should be calculated from only the real-valued transform coefficients from the analysis filterbank 10 even if additional coefficients are available from the second analysis filterbank 19. The calculation of the scale factors should be done in this manner because the scaling performed during the decoding process will be based on synthesized spectral components that are analogous to only the transform coefficients obtained from the analysis filterbank 10. The decoding process will not have access to any coefficients that correspond to or could be derived from spectral components obtained from the second analysis filterbank 19.

G. Implementation

Figure 9:
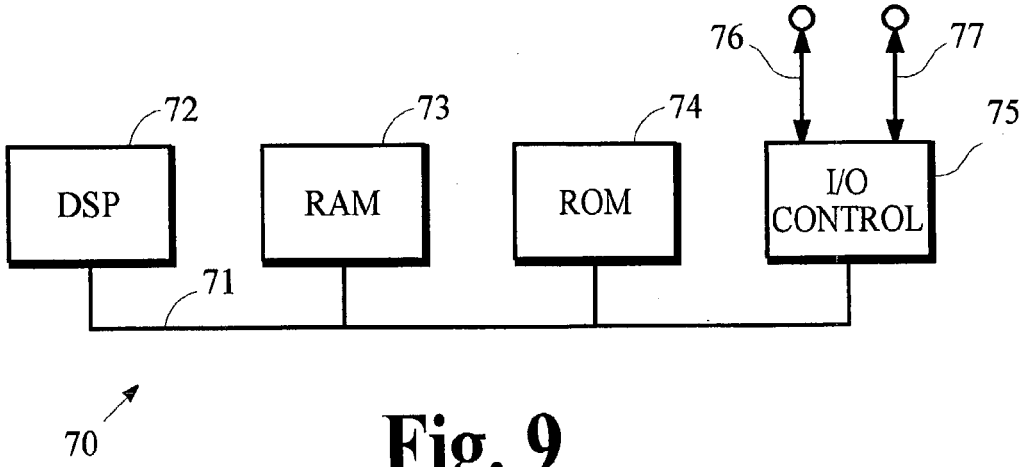
FIG. 9 is a schematic block diagram of an apparatus that can implement various aspects of the present invention.

Various aspects of the present invention may be implemented in a wide variety of ways including software in a general-purpose computer system or in some other apparatus that includes more specialized components such as digital signal processor (DSP) circuitry coupled to components similar to those found in a general-purpose computer system. FIG. 9 is a block diagram of device 70 that may be used to implement various aspects of the present invention in an audio encoder or audio decoder. DSP 72 provides computing resources. RAM 73 is system random access memory (RAM) used by DSP 72 for signal processing. ROM 74 represents some form of persistent storage such as read only memory (ROM) for storing programs needed to operate device 70 and to carry out various aspects of the present invention. I/O control 75 represents interface circuitry to receive and transmit signals by way of communication channels 76, 77. Analog-to-digital converters and digital-to-analog converters may be included in I/O control 75 as desired to receive and/or transmit analog audio signals. In the embodiment shown, all major system components connect to bus 71, which may represent more than one physical bus; however, a bus architecture is not required to implement the present invention.

In embodiments implemented in a general purpose computer system, additional components may be included for interfacing to devices such as a keyboard or mouse and a display, and for controlling a storage device having a storage medium such as magnetic tape or disk, or an optical medium. The storage medium may be used to record programs of instructions for operating systems, utilities and applications, and may include embodiments of programs that implement various aspects of the present invention.

The functions required to practice various aspects of the present invention can be performed by components that are implemented in a wide variety of ways including discrete logic components, integrated circuits, one or more ASICs and/or program-controlled processors. The manner in which these components are implemented is not important to the present invention.

Software implementations of the present invention may be conveyed by a variety machine readable media such as baseband or modulated communication paths throughout the spectrum including from supersonic to ultraviolet frequencies, or storage media that convey information using essentially any recording technology including magnetic tape, cards or disk, optical cards or disc, and detectable markings on media like paper.

The invention claimed is:

1. A method for encoding a plurality of input audio signals, wherein the method comprises:

receiving the plurality of input audio signals and obtaining therefrom one or more baseband signals and one or more residual signals, wherein spectral components of a baseband signal represent spectral components of a respective input audio signal in a first set of frequency subbands and spectral components in an associated residual signal represent spectral components of the respective input audio signal in a second set of frequency subbands that are not represented by the baseband signal;

obtaining energy measures of at least some spectral components of one or more synthesized signals to be generated during decoding, wherein the one or more synthesized signals have spectral components within the second set of frequency subbands;

obtaining energy measures of at least some spectral components of each residual signal;

obtaining from the plurality of input audio signals a coupled-channel signal having spectral components representing a composite of spectral components of two or more of the input audio signals in a third sec of frequency subbands;

obtaining energy measures of at least some spectral components of the coupled-channel signal;

obtaining energy measures of at least some of the spectral components of the two or more input audio signals represented by the coupled-channel signal in the third set of frequency subbands;

calculating coupling scale factors by obtaining square roots of ratios of the energy measures of spectral components in the two or more input audio signals to the energy measures of spectral energy in the coupled-channel signal, square roots of ratios of the energy measures of spectral energy in the coupled-channel signal to the energy measures of spectral components in the two or more input audio signals, ratios of square roots of the energy measures of spectral components in the two or more input audio signals to square roots of the energy measures of spectral energy in the coupled-channel signal, or ratios of square roots of the energy measures of spectral energy in the coupled-channel signal to square roots of the energy measures of spectral components in the two or more input audio signals;

calculating scale factors by obtaining square roots of ratios of the energy measures of spectral components in the residual signals to the energy measures of spectral components in the one or more synthesized signals, square roots of ratios of the energy measures of spectral components in the one or more synthesized signals to the energy measures of spectral components in the residual signals, ratios of square roots of the energy measures of spectral components in the residual signals to square roots of the energy measures of spectral components in the one or more synthesized signals, or ratios of square roots of the energy measures of spectral components in the one or more synthesized signals to square roots of the energy measures of spectral components in the residual signals; and assembling signal information and scaling information into an encoded signal, wherein the signal information represents the spectral components in the one or more baseband signals and the spectral components in the coupled-channel signal, and wherein the scaling information represents the scale factors and the coupling scale factors.

2. The method according to claim 1 wherein the one or more synthesized signals are to be generated at least in part by frequency translation of at least some of the spectral components in the one or more baseband signals.

3. The method according to claim 2 wherein the spectral components of synthesized signals are to be generated by frequency translation that maintains phase coherence.

4. The method according to claim 1 wherein the one or more synthesized signals are to be generated at least in part by a combination of a frequency translation of at least some of the spectral components in the one or more baseband signals and a generation of one or more noise-like signals having spectral levels adapted according to spectral levels in the one or more baseband signals, and wherein the energy measures of spectral components in the one or more synthesized signals is obtained without regard to spectral levels in the noise-like signals.

5. The method according to claim 1 wherein the one or more synthesized signals are to be generated at least in part by generation of one or more noise-like signals.

6. The method according to claim 1 wherein the energy measures of spectral components of the residual signals are obtained from values representing magnitudes of the spectral components.

7. The method according to claim 6 that comprises:

applying a first analysis filterbank to the plurality of input audio signals to obtain the one or more baseband signals and the one or more residual signals; and applying a second analysis filterbank to the plurality of input audio signals to obtain second spectral components;

wherein the energy measures of spectral components in the residual signals are calculated from the spectral components of the residual signals and one or more of the second spectral components.

8. The method according to claim 1 wherein the scaling information represents the scale factors normalized with respect to one or more normalizing values, and wherein the scaling information includes a representation of the one or more normalizing values.

9. The method according to claim 8 wherein the one or more normalizing values are selected from a set of values.

10. The method according to claim 8 wherein the one or more normalizing values comprise a maximum allowable value for scale factors.

11. The method according to claim 1 that calculates a scale factor for one or more of the frequency subbands for the respective residual signals.

12. The method according to claim 11 wherein frequency extents of one or more of the sets of frequency subbands are adapted, and wherein the method assembles into the encoded signal an indication of the adapted frequency extents.

13. The method according to claim 12 wherein the frequency extents are adapted by selecting from a set of extents.

14. The method according to claim 1 wherein the one or more synthesized signals are to be generated at least in part by frequency translation of at least some of the spectral components of the input audio signals in the third set of frequency subbands.

15. The method according to claim 1 that comprises:

detecting one or more characteristics of the plurality of input audio signals;

adapting frequency extents of the first set of frequency subbands, the second set of frequency subbands, or the third set of frequency subbands in response to the detected characteristics; and assembling into the encoded signal an indication of the adapted frequency extents.

16. The method according to claim 1 that comprises:

detecting one or more characteristics of the plurality of input audio signals;

adapting frequency extents of the first set of frequency subbands or the second set of frequency subbands in response to the detected characteristics; and assembling into the encoded signal an indication of the adapted frequency extents.

17. An encoder for encoding a plurality of input audio signals, wherein the encoder has processing circuitry that performs a method for encoding a plurality of input audio signals that comprises:

receiving the plurality of input audio signals and obtaining therefrom one or more baseband signals and one or more residual signals, wherein spectral components of a baseband signal represent spectral components of a respective input audio signal in a first set of frequency subbands and spectral components in an associated residual signal represent spectral components of the respective input audio signal in a second set of frequency subbands that are not represented by the baseband signal;

obtaining energy measures of at least some spectral components of one or more synthesized signals to be generated during decoding, wherein the one or more synthesized signals have spectral components within the second set of frequency subbands;

obtaining energy measures of at least some spectral components of each residual signal;

obtaining from the plurality of input audio signals a coupled-channel signal having spectral components representing a composite of spectral components of two or more of the input audio signals in a third set of frequency subbands;

obtaining energy measures of at least some spectral components of the coupled-channel signal;

obtaining energy measures of at least some of the spectral components of the two or more input audio signals represented by the coupled-channel signal in the third set of frequency subbands;

calculating coupling scale factors by obtaining square roots of ratios of the energy measures of spectral components in the two or more input audio signals to the energy measures of spectral energy in the coupled-channel signal, square roots of ratios of the energy measures of spectral energy in the coupled-channel signal to the energy measures of spectral components in the two or more input audio signals, ratios of square roots of the energy measures of spectral components in the two or more input audio signals to square roots of the energy measures of spectral energy in the coupled-channel signal, or ratios of square roots of the energy measures of spectral energy in the coupled-channel signal to square roots of the energy measures of spectral components in the two or more input audio signals;

calculating scale factors by obtaining square roots of ratios of the energy measures of spectral components in the residual signals to the energy measures of spectral components in the one or more synthesized signals, square roots of ratios of the energy measures of spectral components in the one or more synthesized signals to the energy measures of spectral components in the residual signals, ratios of square roots of the energy measures of spectral components in the residual signals to square roots of the energy measures of spectral components in the one or more synthesized signals, or ratios of square roots of the energy measures of spectral components in the one or more synthesized signals to square roots of the energy measures of spectral components in the residual signals; and assembling signal information and scaling information into an encoded signal, wherein the signal information represents the spectral components in the one or more baseband signals and the spectral components in the coupled-channel signal, and wherein the scaling information represents the scale factors and the coupling scale factors.

18. A method for decoding an encoded signal representing a plurality of input audio signals, wherein the method comprises:

obtaining from the encoded signal signal information, a coupled-channel signal and scaling information, the signal information representing spectral components for one or more baseband signals, the spectral components in each baseband signal representing spectral components of a respective input audio signal in a first set of frequency subbands, the coupled-channel signal having spectral components representing a composite of two or more of the plurality of input audio signals in a third set of frequency subbands, and the scaling information representing scale factors calculated from square roots of ratios of energy measures of spectral components or ratios of square roots of energy measures of spectral components, and representing coupling scale factors calculated from square roots of ratios of energy measures of spectral components of the two or more input audio signals in the third set of frequency subbands to the energy measures of spectral energy in the coupled-channel signal, square roots of ratios of the energy measures of spectral energy in the coupled-channel signal to the energy measures of spectral components of the two or more input audio signals in the third set of frequency subbands, ratios of square roots of the energy measures of spectral components of the two or more input audio signals in the third set of frequency subbands to square roots of the energy measures of spectral energy in the coupled-channel signal, or ratios of square roots of the energy measures of spectral energy in the coupled-channel signal to square roots of the energy measures of spectral components of the two or more input audio signals in the third set of frequency subbands;

generating for each respective baseband signal an associated synthesized signal having spectral components in a second set of frequency subbands that are not represented by the respective baseband signal, wherein the spectral components in the associated synthesized signal are scaled by multiplication or division according to one or more of the scale factors;

generating from the coupled-channel signal a respective decoupled signal for each of the two or more input audio signals represented by the coupled-channel signal, wherein the decoupled signals have spectral components in the third set of frequency subbands that are scaled by multiplication or division according to one or more of the coupling scale factors; and generating a plurality of output audio signals, each output audio signal representing a respective input audio signal and generated from the spectral components in a respective baseband signal and its associated synthesized signal and from the spectral components in respective decoupled signals.

19. The method according to claim 18 wherein the associated synthesized signal is generated at least in part by frequency translation of at least some of the spectral components in the respective baseband signal.

20. The method according to claim 19 wherein the frequency translation maintains phase coherence.

21. The method according to claim 18 wherein the associated synthesized signal is generated at least in part by generation of a noise-like signal having spectral levels adapted according to one or more of the scale factors.

22. The method according to claim 18 that obtains from the encoded signal one or more normalizing values and reverses normalization of the scale factors with respect to the one or more normalizing values.

23. The method according to claim 22 wherein the one or more normalizing values are conveyed in the encoded signal by scaling information that represents selected values in a set of values.

24. The method according to claim 22 wherein the one or more normalizing values comprise a maximum allowable value for scale factors.

25. The method according to claim 18 wherein frequency subbands of the associated synthesized signal are associated with a respective scale factor.

26. The method according to claim 25 that adapts the generation of the associated synthesized signal in response to subband information conveyed in the encoded signal that specifies frequency extents of the frequency subbands.

27. The method according to claim 26 wherein the subband information represents selected frequency extents in a set of extents.

28. The method according to claim 18 wherein the associated synthesized signal is generated at least in part by frequency translation of at least some of the spectral components in the third set of frequency subbands.

29. The method according to claim 18 that comprises:

obtaining from the encoded signal an indication of frequency extents of the first, second or third sets of frequency subbands; and adapting the generation of synthesized signals and decoupled signals in response to the indication.

30. The method according to claim 18 that comprises:

obtaining from the encoded signal an indication of frequency extents of the first or second sets of frequency subbands; and adapting the generation of synthesized signals and decoupled signals in response to the indication.

31. A decoder for decoding an encoded signal representing a plurality of input audio signals, wherein the decoder has processing circuitry that performs a method for decoding an encoded signal representing a plurality of input audio signals that comprises:

obtaining from the encoded signal signal information, a coupled-channel signal and scaling information, the signal information representing spectral components for one or more baseband signals, the spectral components in each baseband signal representing spectral components of a respective input audio signal in a first set of frequency subbands, the coupled-channel signal having spectral components representing a composite of two or more of the plurality of input audio signals in a third set of frequency subbands, and the scaling information representing scale factors calculated from square roots of ratios of energy measures of spectral components or ratios of square roots of energy measures of spectral components, and representing coupling scale factors calculated from square roots of ratios of energy measures of spectral components of the two or more input audio signals in the third set of frequency subbands to the energy measures of spectral energy in the coupled-channel signal, square roots of ratios of the energy measures of spectral energy in the coupled-channel signal to the energy measures of spectral components of the two or more input audio signals in the third set of frequency subbands, ratios of square roots of the energy measures of spectral components of the two or more input audio signals in the third set of frequency subbands to square roots of the energy measures of spectral energy in the coupled-channel signal, or ratios of square roots of the energy measures of spectral energy in the coupled-channel signal to square roots of the energy measures of spectral components of the two or more input audio signals in the third set of frequency subband;

generating for each respective baseband signal an associated synthesized signal having spectral components in a second set of frequency subbands that are not represented by the respective baseband signal, wherein the spectral components in the associated synthesized signal are scaled by multiplication or division according to one or more of the scale factors;

generating from the coupled-channel signal a respective decoupled signal for each of the two or more input audio signals represented by the coupled-channel signal, wherein the decoupled signals have spectral components in the third set of frequency subbands that are scaled by multiplication or division according to one or more of the coupling scale factors; and generating a plurality of output audio signals, each output audio signal representing a respective input audio signal and generated from the spectral components in a respective baseband signal and its associated synthesized signal and from the spectral components in respective decoupled signals.

32. A method for encoding a plurality of input audio signals, wherein the method comprises:

receiving the plurality of input audio signals and obtaining therefrom a plurality of baseband signals, a plurality of residual signals and a coupled-channel signal, wherein spectral components of a baseband signal represent spectral components of a respective input audio signal in a first set of frequency subbands and spectral components of an associated residual signal represent spectral components of the respective input audio signal in a second set of frequency subbands that are not represented by the baseband signal, and wherein spectral components of the coupled-channel signal represent a composite of spectral components of two or more of the input audio signals in a third set of frequency subbands;

obtaining energy measures of at least some spectral components of each residual signal and the two or more input audio signals represented by the coupled-channel signal; and assembling control information and, signal information into an encoded signal, wherein the control information is derived from the energy measures and wherein the signal information represents the spectral components in the plurality of baseband signals and the coupled-channel signal.

33. The method according to claim 32 that comprises;

obtaining energy measures of at least some spectral components of one or more synthesized signals to be generated during decoding, wherein the one or more synthesized signals have spectral components within the second set of frequency subbands; and deriving at least some of the control information by calculating square roots of ratios of the energy measures or ratios of square roots of the energy measures.

34. The method or claim 33 wherein at least some of the spectral components of the one or more synthesized signals are to be synthesized from spectral components in the third set of frequency subbands.

35. The method according to claim 32 wherein frequency extents of the sets of frequency subbands are adapted, and wherein the method assembles into the encoded signal an indication of the adapted frequency extents.

36. A method for decoding an encoded signal representing a plurality of input audio signals, wherein the method comprises:

obtaining control information and signal information from the encoded signal, wherein the control information is derived from energy measures of spectral components and the signal information represents spectral components of a plurality of baseband signals and a coupled-channel signal, wherein the spectral components in each baseband signal represent spectral components of a respective input audio signal in a first set of frequency subbands and the spectral components of the coupled-channel signal represent a composite of spectral components in a third set of frequency subbands of two or more of the plurality of input audio signals;

generating for each respective baseband signal an associated synthesized signal having spectral components in a second set of frequency subbands that are not represented by the respective baseband signal, wherein the spectral components in the associated synthesized signal are scaled according to the control information;

generating from the coupled-channel signal a respective decoupled signal for each of the two or more input audio signals represented by the coupled-channel signal, wherein the decoupled signals have spectral components in the third set of frequency subbands that are sealed according to the control information; and generating a plurality of output audio signals, wherein each output audio signal represents a respective input audio signal and is generated from the spectral components in a respective baseband signal and its associated synthesized signal, and wherein output audio signals representing the two or more audio signals are also generated from the spectral components in the respective decoupled signals.

37. The method according to claim 36 wherein the control information conveys a representation of scale factors calculated from square roots of ratios of energy measures or ratios of square roots of the energy measures, and wherein some of the energy measures in the ratios represent energy of at least some spectral components of the synthesized signals.

38. The method of claim 37 wherein at least some of the spectral components of the one or more synthesized signals are synthesized from spectral components in the third set of frequency subbands.

39. The method according to claim 36 wherein frequency extents of one or more of the sets of frequency subbands are adapted in response to the control information.

40. A computer-readable medium recording a program of instructions executable by a computer, wherein execution of the program of instructions causes the computer to perform the method of claim 36.

41. The medium according to claim 40 wherein the control information conveys a representation of scale factors calculated from square roots of ratios of energy measures or ratios of square roots of the energy measures, and wherein some of the energy measures in the ratios represent energy of at least some spectral components of the synthesized signals.

42. The medium according to claim 41 wherein at least some of the spectral components of the one or more synthesized signals are synthesized from spectral components in the third set of frequency subbands.

43. The medium according to claim 40 wherein frequency extents of one or more of the sets of frequency subbands are adapted in response to the control information.

44. A computer-readable medium recording a program of instructions executable by a computer, wherein execution of the program of instructions causes the computer to perform the method of claim 1.

45. A computer-readable medium recording a program of instructions executable by a computer, wherein execution of the program of instructions causes the computer to perform the method of claim 18.

46. The medium according to claim 45 wherein the associated synthesized signal is generated at least in part by frequency translation of the least some of the spectral components in the respective baseband signal.

47. The medium according to claim 46 wherein the frequency translation maintains phase coherence.

48. The medium according to claim 45 wherein the associated synthesized signal is generated at least in part by generation of a noise-like signal having spectral levels adapted according to one or more of the scale factors.

49. The medium according to claim 45 wherein the method obtains from the encoded signal one or more normalizing values and reverses normalization of the scale factors with respect to the one or more normalizing values.

50. The medium according to claim 49 wherein the one or more normalizing values are conveyed in the encoded signal by scaling information that represents selected values in a set of values.

51. The medium according to claim 49 wherein the one or more normalizing values comprise a maximum allowable value for scale factors.

52. The medium according to claim 45 wherein frequency subbands of the associated synthesized signal are associated with a respective scale factor.

53. The medium according to claim 52 wherein the method adapts the generation of the associated synthesized signal in response to subband information conveyed in the encoded signal that specifies frequency extents of the frequency subbands.

54. The medium according to claim 53 wherein the subband information represents selected frequency extents in a set of extents.

55. The medium according to claim 45 wherein the associated synthesized signal is generated at least in part by frequency translation of at least some of the spectral components in the third sat of frequency subbands.

56. The medium according to claim 45 wherein the method comprises:

obtaining from the encoded signal an indication of frequency extents of the first or second sets of frequency subbands; and adapting the generation of synthesized signals and decoupled signals in response to the indication.

57. An encoder for encoding a plurality of input audio signals, wherein the encoder has processing circuitry that performs a method for encoding a plurality of input audio signals that comprises:

receiving the plurality of input audio signals and obtaining therefrom a plurality of baseband signals, a plurality of residual signals and a coupled-channel signal, wherein spectral components of a baseband signal represent spectral components of a respective input audio signal in a first set of frequency subbands and spectral components of an associated residual signal represent spectral components of the respective input audio signal in a second set of frequency subbands that are not represented by the baseband signal, and wherein spectral components of the coupled-channel signal represent a composite of spectral components of two or more of the input audio signals in a third set of frequency subbands;

obtaining energy measures of at least some spectral components of each residual signal and the two or more input audio signals represented by the coupled-channel signal; and assembling control information and signal information into an encoded signal, wherein the control information is derived from the energy measures and wherein the signal information represents the spectral components in the plurality of baseband signals and the coupled-channel signal.

58. A decoder for decoding an encoded signal representing a plurality of input audio signals, wherein the decoder has processing circuitry that performs a method for decoding an encoded signal representing a plurality of input audio signals that comprises;

obtaining control information and signal information from the encoded signal, wherein the control information is derived from energy measures of spectral components and the signal information represents spectral components of a plurality of baseband signals and a coupled-channel signal, wherein the spectral components in each baseband signal represent spectral components of a respective input audio signal in a first set of frequency subbands and the spectral components of the coupled-channel signal represent a composite of spectral components in a third set of frequency subbands of two or more of the plurality of input audio signals;

generating for each respective baseband signal an associated synthesized signal having spectral components in a second net of frequency subbands that are not represented by the respective baseband signal, wherein the spectral components in the associated synthesized signal are scaled according to the control information;

generating from the coupled-channel signal a respective decoupled signal for each of the two or more input audio signals represented by the coupled-channel signal, wherein the decoupled signals have spectral components in the third set of frequency subbands that are scaled according to the control information; and generating a plurality of output audio signals, wherein each output audio signal represents a respective input audio signal and is generated from the spectral components in a respective baseband signal and its associated synthesized signal, and wherein output audio signals representing the two or more audio signals are also generated from the spectral components in the respective decoupled signals.

59. A computer-readable medium recording a program of instructions executable by a computer, wherein execution of the program of instructions causes the computer to perform the method of claim 32.

60. A computer-readable medium recording encoded information representing one or more input audio signals, wherein the encoded information was generated by the method of claim 1.

61. The medium according to claim 60 wherein the one or more synthesized signals are to be generated at least in part by frequency translation of at least some of the spectral components of the input audio signals in the third set of frequency subbands.

62. The medium according to claim 60 wherein the method comprises:

detecting one or more characteristics of the one or more input audio signals;

adapting frequency extents of the first set of frequency subbands or the second set of frequency subbands in response to the detected characteristics; and assembling into the encoded signal an indication of the adapted frequency extents.

63. A computer-readable medium recording encoded information representing a plurality of input audio signals, wherein the encoded information, was generated by the method of claim 32.

64. The medium according to claim 63 wherein the method comprises:

obtaining energy measures of at least some spectral components of one or more synthesized signals to be generated during decoding, wherein the one or more synthesized signals have spectral components within the second set of frequency subbands and at least some of the spectral components of the one or more synthesized signals are to be synthesized from spectral components in the third set of frequency subbands; and deriving at least some of the control information by calculating square roots of ratios of the energy measures or ratios of square toots of the energy measures.

65. The medium according to claim 63 wherein frequency extents of the sets of frequency subbands are adapted, and wherein the method assembles into the encoded signal an indication of the adapted frequency extents.

* * * * *